United States Patent [19]

LaValle et al.

[11] Patent Number: 4,614,274

[45] Date of Patent: Sep. 30, 1986

[54] CONTROL SYSTEM FOR AUTOMATIC MATERIAL HANDLING CRANE

[75] Inventors: Dean R. LaValle, Hugo; Philip A. McLain, Isanti, both of Minn.

[73] Assignee: PaR Systems Corp., St. Paul, Minn.

[21] Appl. No.: 606,647

[22] Filed: May 3, 1984

Related U.S. Application Data

[62] Division of Ser. No. 214,190, Dec. 8, 1980, Pat. No. 4,456,132.

[51] Int. Cl.[4] ..... B66C 13/40

[52] U.S. Cl. ..... 212/160; 340/825.74

[58] Field of Search ..... 212/159, 160, 161, 165; 340/825.06, 825.71, 825.72, 825.76, 825.74; 414/273, 909

[56] References Cited

U.S. PATENT DOCUMENTS

| | | | |
|---|---|---|---|
| 2,862,073 | 12/1958 | Blow et al. | 340/825.76 |
| 3,437,997 | 4/1969 | Yoshida et al. | 340/825.76 |
| 3,463,327 | 8/1969 | Lester | 212/160 |
| 3,587,100 | 6/1971 | Sparta et al. | 340/825.76 |
| 3,774,217 | 11/1973 | Bonner | 212/160 |
| 3,854,122 | 12/1974 | Cross | 340/825.06 |
| 4,004,156 | 1/1977 | Schuller | 212/160 |
| 4,176,995 | 12/1979 | Wise | 212/161 |
| 4,184,118 | 1/1980 | Cannalte et al. | 340/825.06 |

FOREIGN PATENT DOCUMENTS

| | | | |
|---|---|---|---|
| 54-55949 | 4/1979 | Japan | 212/160 |

OTHER PUBLICATIONS

Harrison et al, *Introduction to Automatic Controls*, 1969, pp. 380–386, Harper & Row, New York, NY.

*Primary Examiner*—Trygve M. Blix
*Assistant Examiner*—Thomas J. Brahan
*Attorney, Agent, or Firm*—Kinney & Lange

[57] ABSTRACT

An automatic material handling crane system services a plurality of stations in an industrial plant. The system includes a crane which is movable on a track, a mast which is carried by the crane, and a material handling mechanism which is carried by the mast. Position encoders provide signals indicative of the position of the crane on the track and the mast with respect to the crane. Both manual and remote controls are provided to operate the crane system. The manual control is carried by the crane and provides manual control signals. The remote control is positioned at a remote location with respect to the crane and stores a schedule of operations of the crane, mast and material handling mechanism. The remote control signals provided by the remote control are based on the schedule and on status information relating to the crane, the mast and material handling mechanism. A crane-carried control provides control signals to control the positioning of the crane and the mast, and to operate the material handling mechanism as a function of signals from the crane and mast position encoders and either the manual control signal or the remote control signals. The crane-carried control also provides the status information to the remote control as a function of the signals from the crane and mast position encoders. A communication link transmits the remote control signals to the crane-carried control, and transmits the status information to the remote control.

5 Claims, 12 Drawing Figures

Fig. 7A (ALARM CONDITION MODE)
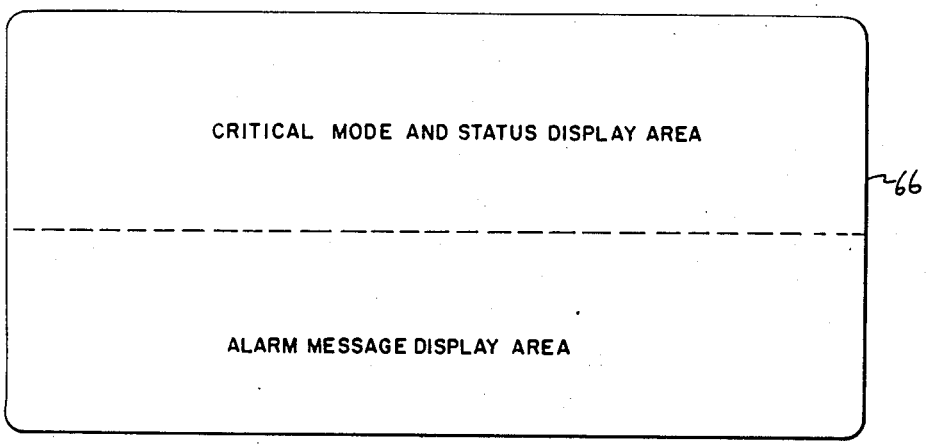
Fig. 7B (NORMAL CONDITION MODE)
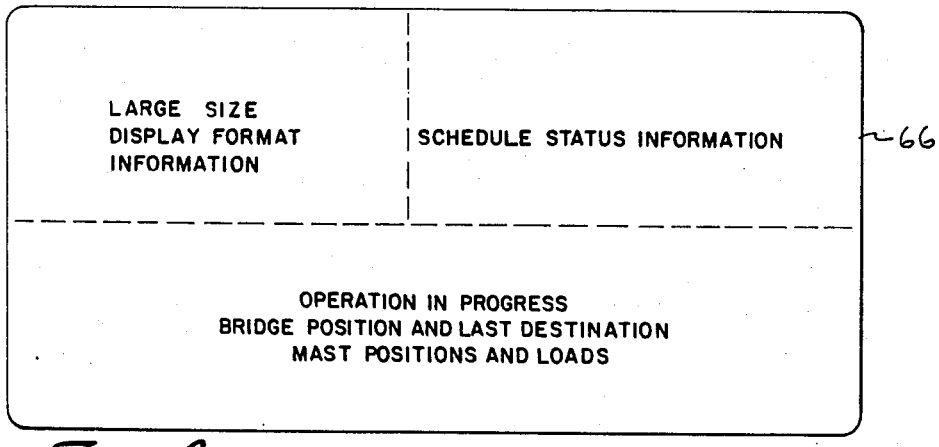
Fig. 7C (ACTIVE CONDITION MODE)
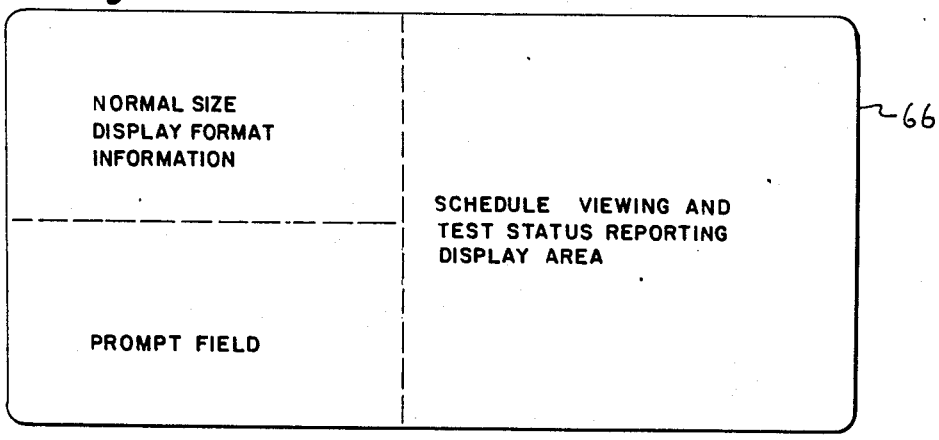

CONTROL SYSTEM FOR AUTOMATIC MATERIAL HANDLING CRANE

This is a division of application Ser. No. 06/214,190, filed Dec. 8, 1980, now U.S. Pat. No. 4,456,132.

REFERENCE TO COPENDING APPLICATION

Reference is hereby made to a copending application by Karl E. Neumeier and Robert J. Sullivan, Ser. No. 187,750, filed Sept. 16, 1980, entitled "Grab Mechanism", now U.S. Pat. No. 4,326,937, which is assigned to the same assignee as the present application.

BACKGROUND OF THE INVENTION

1. Field of the Invention

The present invention relates to material handling systems for servicing a plurality of stations, and in particular to a system capable of either manual on-site control or remote control.

2. Description of the Prior Art

In various industrial processes, materials are serviced at various work stations and, in many cases, materials are moved from one station to another in a predetermined pattern. One example of such a process is metal refining in which metals are plated on electrolytic plates. For example, in the refining of zinc, a plurality of alternately spaced plates are arranged in each electrolytic cell. One group of plates is anodes and another group is cathodes. In a typical metal refining operation, the plates are moved in stages from the electrolytic cells to a washing station; plates at the washing station are moved to a stripping station at which the zinc is stripped from the plates; and plates at the stripping station are moved to the electrolytic cells and begin the process again. Each of these steps involves the grabbing, raising, moving and lowering of the plates. In the past, the process of moving the plates from station-to-station has involved relatively complicated equipment and a substantial amount of human labor. From both an efficiency and a safety standpoint, it is desirable to reduce the involvement of the workers in this environment.

SUMMARY OF THE INVENTION

The present invention is a material handling system for servicing a plurality of stations in an industrial process. The system includes a crane which is movable on a track, a mast which is carried by and movable with respect to the crane, and a material handling mechanism carried by the mast. Crane drive means move the crane, mast drive means move the mast, and actuator means operate the material handling mechanism. Crane position encoder means provide signals indicative of the position of the crane on the track, and mast position encoder means provide signals indicative of the position of the mast.

The system includes manual control means carried by the crane and remote control means positioned at a remote location with respect to the crane. The manual control means provides manual control signals indicating desired movements of the crane, mast and material handling mechanism. The remote control means stores the schedule of operations of the crane, mast and material handling mechanism and provides remote control signals based upon the schedule and upon status information relating to the crane, mast and material handling mechanism. Selection means selects either the manual or remote control signals for operating the system.

Control signals to the crane drive means, the mast drive means, and the actuator means are provided by crane-carried control means. These control signals are a function of the signals from the crane position encoder means, the mast position encoder means and either the manual control signals or the remote control signals, depending upon which signals have been selected by the selection means. The crane-carried control means also provides status information as a function of the signals from the crane position encoder means and the mast position encoder means.

Communication link means provide the transmission of signals between the remote control means and the crane-carried control means. The remote control signals are transmitted from the remote control means to the crane-carried control means, and the status information is transmitted from the crane-carried control means to the remote control means.

In preferred embodiments of the present invention, the remote control means includes a digital computer, a display, and a control panel. The digital computer stores sequences of operation of the crane, mast and material handling mechanism for servicing each of the plurality of stations. A schedule is created by an operator at the remote location by means of the control panel. The schedule is made up of one or more series of stations to be serviced. Each series includes information sufficient to service a group of stations all requiring the same type of service.

In the preferred embodiments, the digital computer prompts the operator by means of messages displayed in the display. The operator is not required to enter all of the sequences of steps for each of the stations to be serviced, but merely is required to identify the type of service and station to be serviced. The control panel preferably includes keys or push buttons which are selectively lighted by the digital computer to indicate only those choices which can properly be made by the operator in response to the prompting messages displayed on the display.

The communication link means preferably is a microwave communication link having two audio subcarriers for transmitting data between the remote control means and the crane-carried control means. One of the subcarriers is used to transmit the remote control signals from the remote control means or to transmit the status information from the crane-carried control means. The other subcarrier indicates the status of the system. If, for example, both subcarriers transmitted by the crane-carried control means are absent, this indicates that the crane is not in operation. If both subcarriers are present, the crane is in operation. If, however, only one of the two subcarriers is present, this indicates to the remote control means that a malfunction has occurred, and the remote control means takes appropriate action to inhibit operation of the crane and warn the operator of a potentially dangerous condition.

BRIEF DESCRIPTION OF THE DRAWINGS

FIGS. 7A-7C illustrate operation of the remote console display in an alarm condition mode, a normal condition mode, and an active condition mode, respectively.

DETAILED DESCRIPTION OF THE PREFERRED EMBODIMENTS

The Crane

Figure 1:
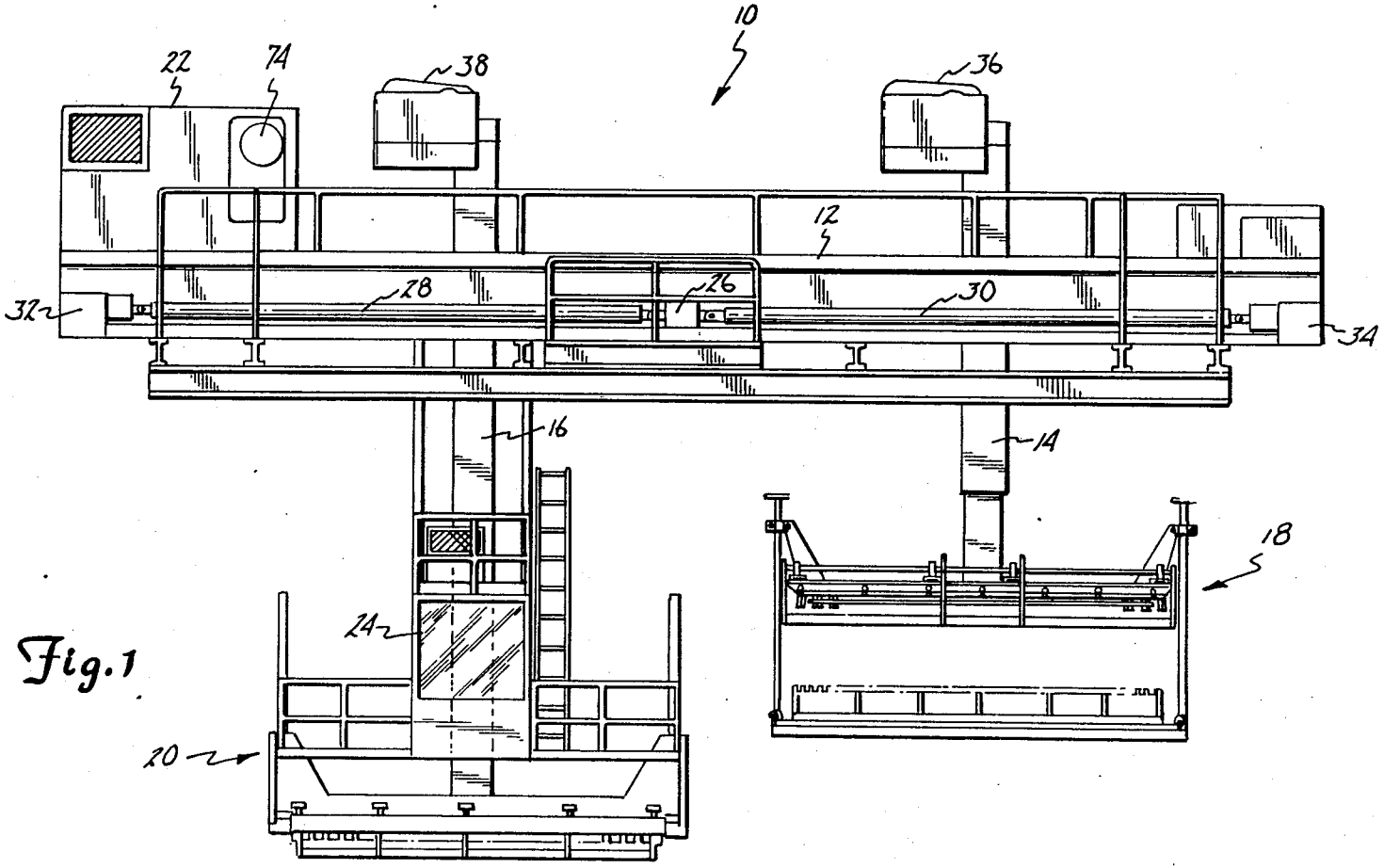
FIG. 1 is a front plan view of the crane system of the present invention.

FIG. 1 shows automatic cathode/anode handling crane 10 for use in handling cathode and anode plates in a metal refining facility. Crane 10 includes a traveling bridge structure 12 which extends between and moves on a pair of overhead rails (not shown) located in the metal refining plant. Platform 12 supports a pair of telescoping masts 14 and 16. Mast 14 is termed the "rotate mast" because of its ability to be rotated by 180°. Mast 16 is termed the "non-rotate mast".

Mounted at the lower end of rotate mast 14 is cathode/anode grapple 18. Similarly, cathode/anode grapple 20 is mounted at the lower end of non-rotate mast 16. In the preferred embodiment shown in FIG. 1, grapples 18 and 20 are preferably of the form shown in the previously-mentioned copending patent application entitled "Grab Mechanism". Telescoping masts 14 and 16 are raised and lowered in order to raise and lower grapples 18 and 20, respectively.

Mounted on bridge 12 is electrical power center 22, which receives electrical power operate crane 10, and also includes electrical control circuitry for controlling the various motors and actuators of crane 10. Mounted below platform 12 and in line with nonrotating mast 16 is operator-control cab 24. As will be described in detail later, an operator can manually control crane 10 by means of manual controls within cab 24. In addition, crane 10 is capable of remote control from a control room which is preferably located outside of the room in which crane 10 is located.

Crane 10 is moved on the rails by bridge drive motor 26, which is located at the center of bridge 12. Bridge drive motor 26 drives shafts 28 and 30, which in turn drive wheel assemblies 32 and 34, respectively, on opposite sides of bridge 12.

Figure 2:
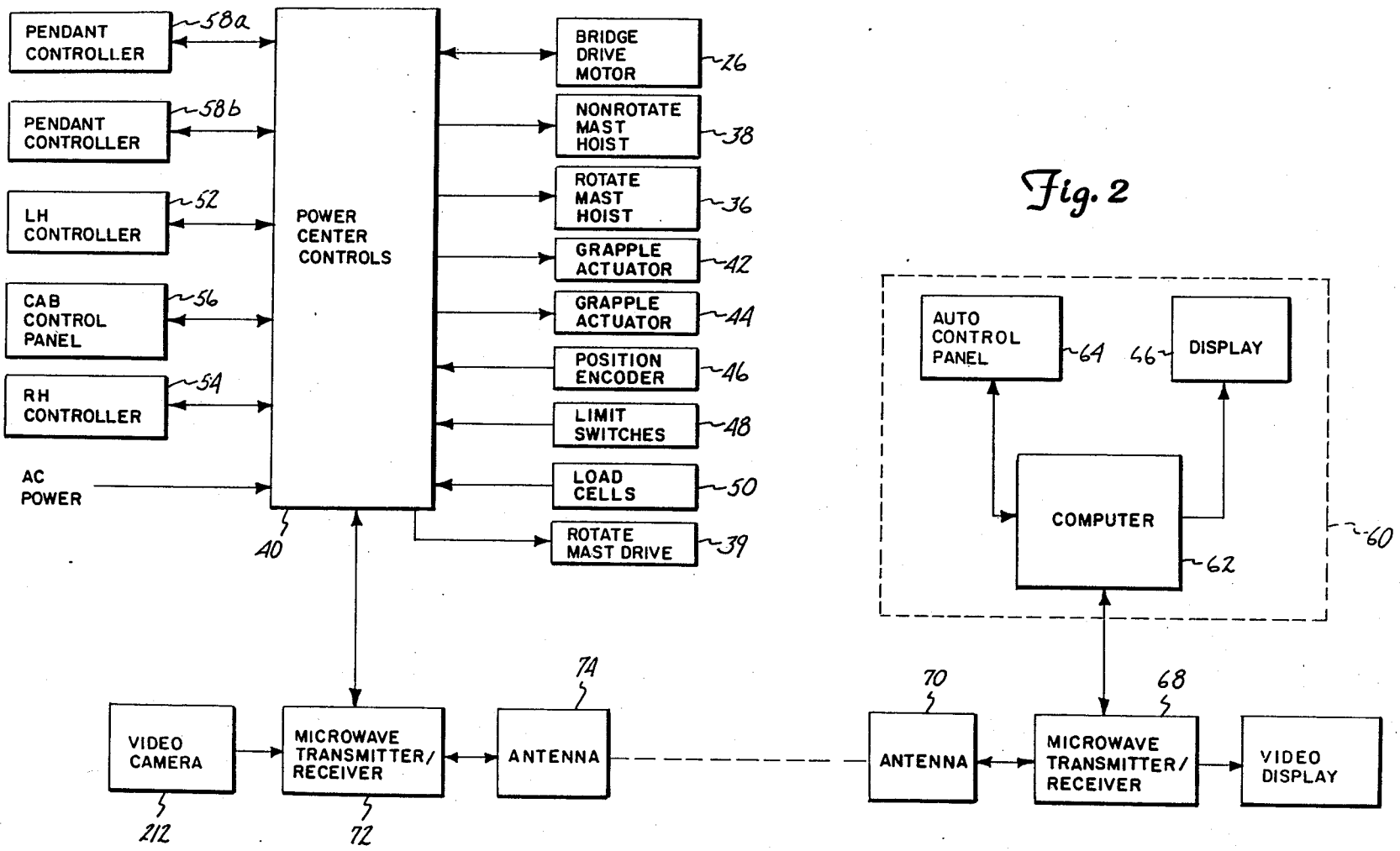
FIG. 2 is an electrical block diagram of a control system of the crane system of FIG. 1.

Masts 14 and 16 are raised and lowered by hoists 36 and 38, respectively, and mast 14 may be rotated by rotate drive 39 (shown in FIG. 2). In a preferred embodiment, hoists 36 and 38 are mounted at the upper ends of masts 14 and 16, respectively. Each hoist assembly preferably includes a hoist cable drum driven by an electrical motor. Cables wound on the drum raise and lower the telescoping movable portion of the mast. Hoist assemblies 36 and 38 also include position encoders coupled to the drums for providing signals from which the vertical position of the grapples can be determined. In addition, electronic load cells are preferably provided in hoist assemblies 36 and 38 to provide an indication of the load on the grapple 18 or 20.

The Control System

FIG. 2 is an electrical block diagram showing the control system of crane 10 of FIG. 1. The operations of crane 10 are controlled by power center controls 40, which are located within power center 22. Power center controls 40 receive AC power, which in one preferred embodiment is 600 VAC, three-phase, 60 Hz power. Power center controls 40, which preferably include a digital computer together with associated interface and control circuitry, provide control signals to bridge drive motor 26, rotate mast hoist 36, nonrotate mast hoist 38, rotate mast drive 39, and grapple actuators 42 and 44. Bridge drive motor 26 moves crane 10 in a horizontal direction along a track defined by the rails (not shown). Mast hoists 36 and 38 control the vertical position of grapples 18 and 20. Grapple actuators 42 and 44 operate grapples 18 and 20 to grab or release either anodes or cathodes when grapples 18 and 20 have been lowered into position at one of the stations.

Power center controls 40 receive feedback signals from position encoers 46, limit switches 48, and load cells 50. Position encoders 46 provide position information for bridge 12 in a horizontal direction and for the vertical positions of grapples 18 and 20. Limit switches 48 provide signals indicating the location and status of grapples 18 and 20. Load cells 50 provide signals indicating the loads on grapples 18 and 20.

Power center controls 40 receive manual control signals from lefthand controller 52, righthand controller 54, and cab control panel 56, all of which are located within cab 24.

In addition, power center controls 40 receive manual control signals from pendant controllers 58*a* and 58*b*. Pendant controller 58*a* is normally carried on rotate mast 14, while pendant controller 58*b* is normally carried on nonrotate mast 16.

In addition to manual control, the control system of FIG. 2 also permits remote control of crane 10 from a control room. Located within the control room are remote console 60 (which includes computer 62, keyboard 64, and display 66), microwave transmitter/-receiver 68, and microwave antenna 70. Microwave transmitter/receiver 72 and antenna 74 are located on crane 10 within power center 22. Power center controls 40 receive remote control signals from computer 62 through the microwave communication link formed by transmitter/receiver 68, antenna 70, transmitter/-receiver 72, and antenna 74. Power center controls 40 provide status information relating to the position and status of crane 10 to computer 62 through the microwave communication link.

The control system of FIG. 2 permits operation of crane 10 in three distinct modes: the remote (automatic) mode, the cab (manual) mode, and the pendant (manual) mode.

In the remote mode, power center controls 40 use remote control signals from computer 62, and crane 10 is under the control of computer 62. The operation of crane 10 is determined by a schedule of operations stored in memory by computer 62. In this mode, both rotate mast 14 and nonrotate mast 16 may be operated simultaneously or independently.

The cab mode allows an operator to manually control all crane functions from crane mounted cab 24. Power center controls 40 utilize the manual control signals provided through left and righthand controllers 52 and 54 and cab control panel 56. In the cab mode, the operator has the option of controlling masts 14 and 16 simultaneously or independently.

The pendant mode allows an operator stationed on a walkway beside the metal refining cells and work stations to manually control many of the functions of crane 10. The pendant mode is intended for maintenance purposes or other unusual operating conditions. Pendant controller 58*a* allows control by the operator of functions associated with rotate mast 14, and pendant controller 58*b* allows control of functions associated with nonrotate mast 16. The position of bridge 12 can be controlled from either pendant 58*a* or pendant 58*b*. In a preferred embodiment, power center controls 40 limit the maximum speed of bridge drive motor 26 when the pendant mode is selected.

The Manual Cab Mode of Operation

Figure 3A:
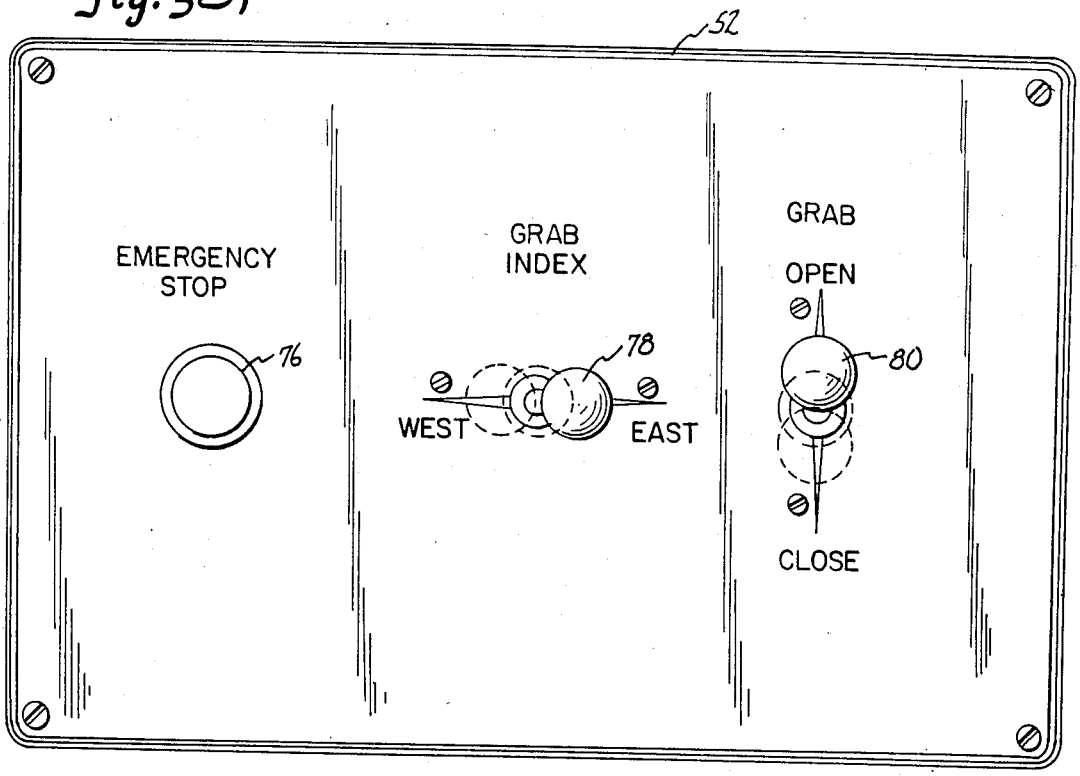
FIGS. 3A and 3B show left and righthand manual controllers located in the cab of the crane system of FIG. 1.
Figure 3B:
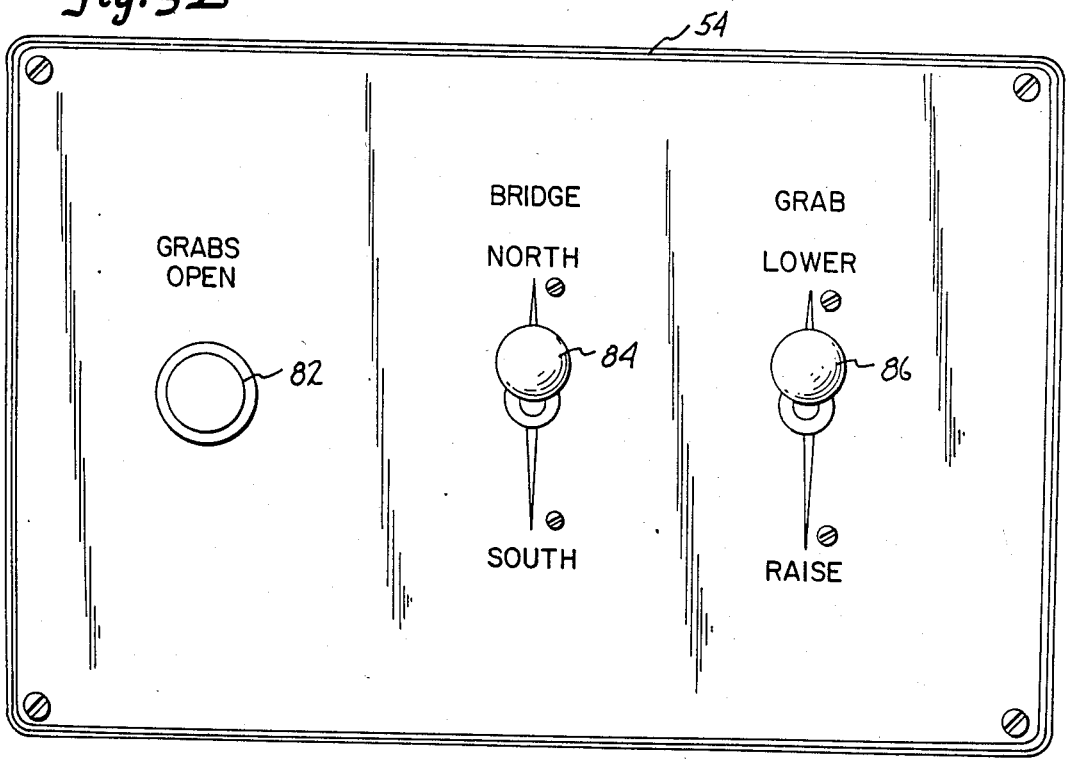
Figure 4D:
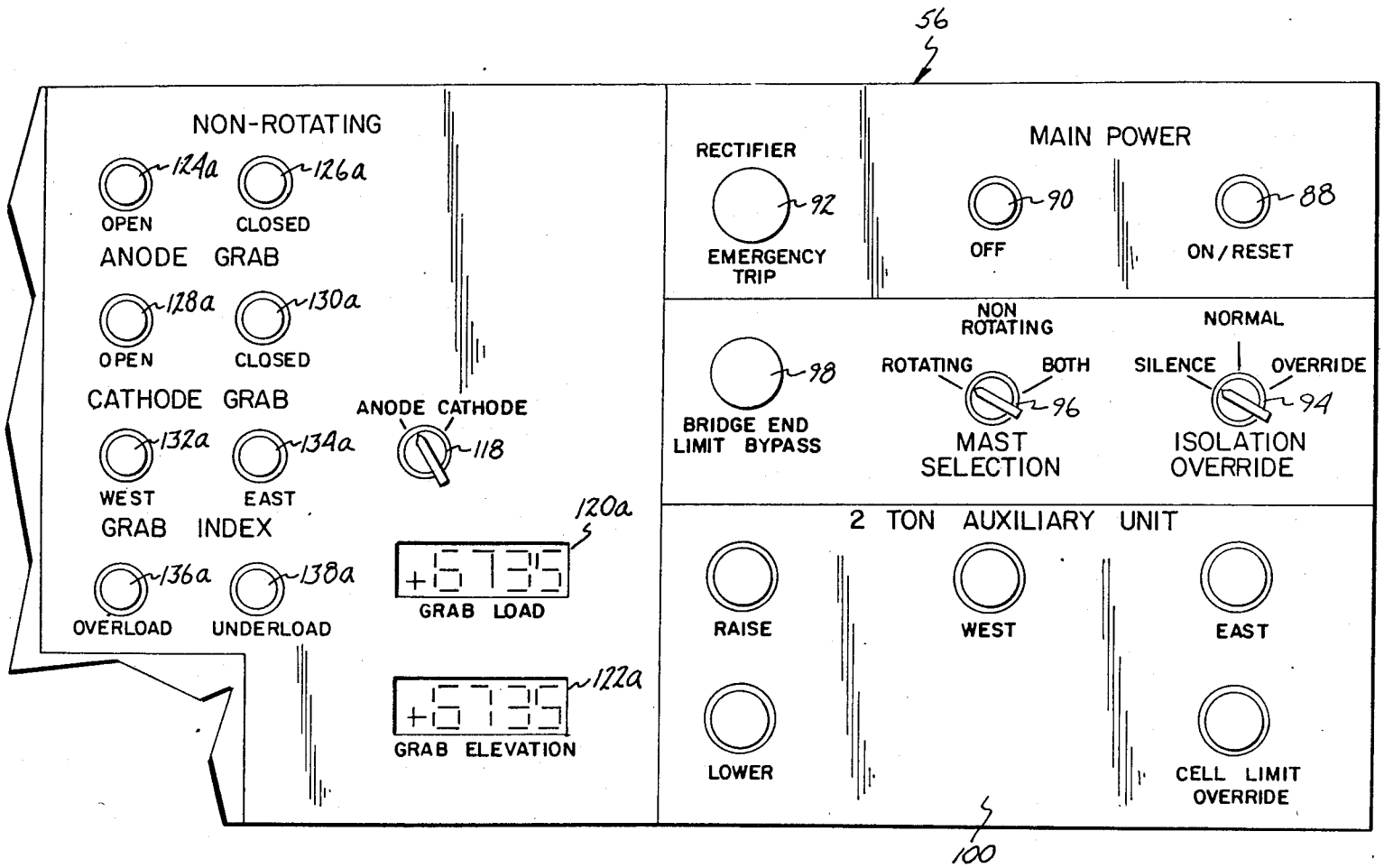
FIGS. 4A and 4B show a cab control panel located within the cab of the crane system of FIG. 1.
Figure 4B:
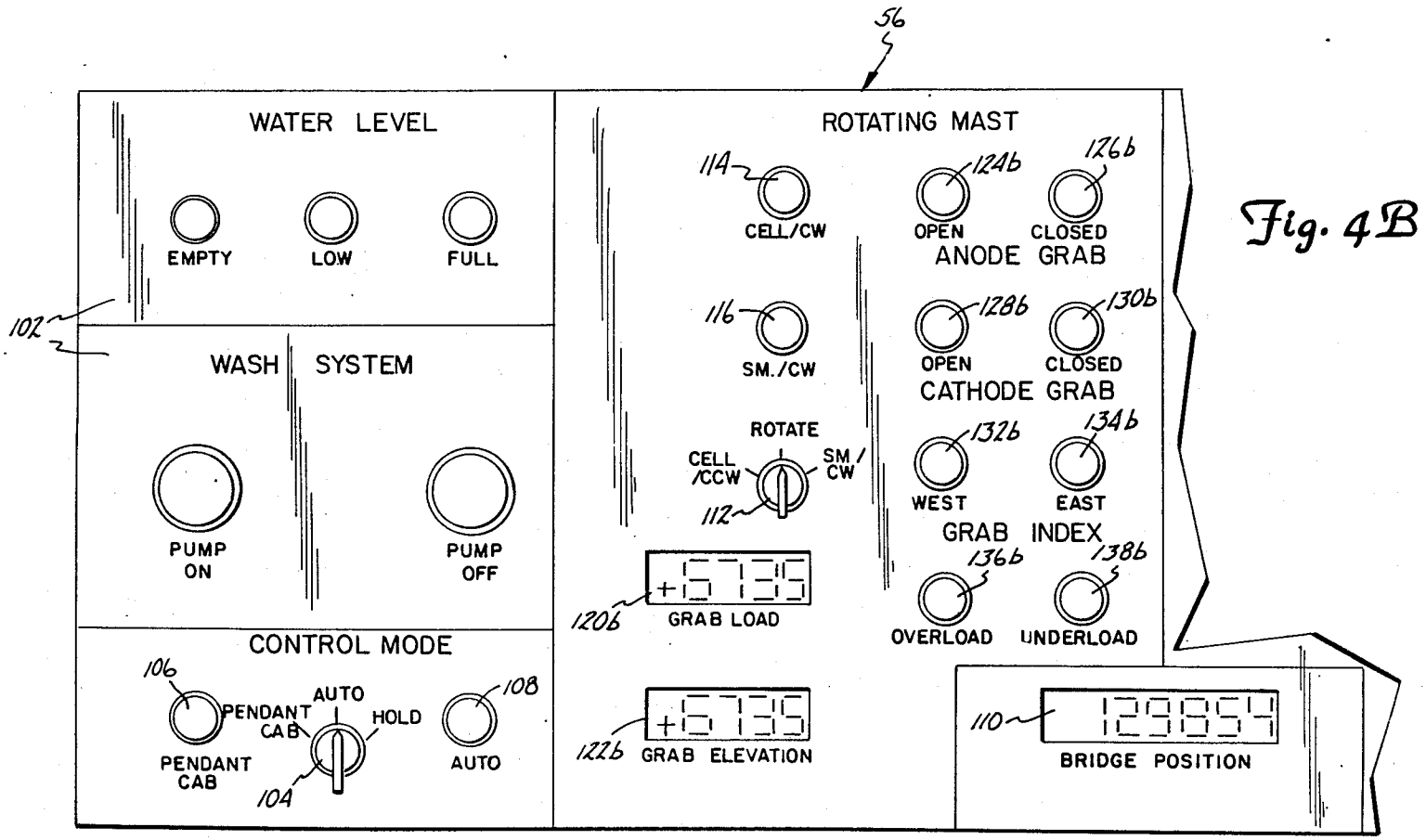

FIGS. 3A and 3B show the manual controls of lefthand controller 52 and righthand controller 54, respectively and FIGS. 4A and 4B show the manual controls of cab control panel 56. All functions of crane 10 in the cab mode are controlled manually by the operator by means of left and righthand controllers 52 and 54 and cab control panel 56.

Lefthand controller 52, shown in FIG. 3A, includes EMERGENCY STOP pushbutton 76, GRAB INDEX joystick 78, and GRAB OPEN/CLOSE joystick 80. Depressing EMERGENCY STOP pushbutton 76 disables all crane functions. GRAB INDEX joystick 78 selects the index position of grapples 18 and 20. The grabs of grapples 18 and 20 are open or closed by actuating GRAB OPEN/CLOSE joystick 80.

Righthand controller 54, shown in FIG. 3B, also includes three controls. GRAB OPEN pushbutton 82 is depressed to allow the grabs of grapples 18 and 20 to open. BRIDGE NORTH/SOUTH joystick 84 provides signals which control the operation of bridge drive motor 26. The velocity of bridge 12 is proportional to the deflection of joystick 84. GRAB LOWER/RAISE joystick 86 provides control signals which operate hoists 36 and 38. The rate of change of elevation of grapples 18 and 20 is proportional to deflection of joystick 86.

In the upper righthand corner of control panel 56 (FIG. 4A) are POWER ON/RESET pushbutton 88, POWER OFF pushbutton 90 and RECTIFIER EMERGENCY TRIP switch 92. Depressing pushbutton 88 energizes crane 10, and depressing pushbutton 90 deenergizes crane 10. Depressing RECTIFIER EMERGENCY TRIP switch 92 deenergizes crane 10 and electrolytic cell rectifiers in the metal refining plant.

ISOLATION OVERRIDE switch 94 is a selection switch having a "Normal", a "Silence" and an "Override" position. The Normal position allows normal operation of an isolation detection system which ensures electrical isolation between crane 10 and the electrolytic cells. The Silence position disables the isolation alarm, and the Override position bypasses the isolation detection system and allows crane operation to resume.

MAST SELECTION switch 96 is a select switch having "Rotating", "Non-rotating", and "Both" positions. The rotating and non-rotating positions allow independent operation of rotate mast 14 and non-rotate mast 16. Masts 14 and 16 are operated simultaneously when MAST SELECTION switch 96 is placed in the "Both" position. Switch 96 operates in the cab mode only.

The travel of crane 10 on the track has predetermined end limits, and power center controls 40 prevent crane 10 from moving beyond these end limits. BRIDGE END LIMIT BYPASS pushbutton 98 is depressed by the operator to allow crane 10 to travel beyond its normal end limits. This function is normally performed when the operator desires to move crane 10 to a maintenance area which is beyond the normal end limit of crane travel.

In the embodiment shown in FIGS. 4A and 4B, cab control panel 56 includes a group of pushbuttons 100 which control operation of a two-ton auxiliary hoist, and another group of controls and indicators 102 relating to a wash system.

In the lower lefthand corner (FIG. 4B) of cab control 56 is control mode selector switch 104 and indicators 106 and 108. CONTROL MODE select switch 104 has a "Pendant/Cab" position, and "Auto" position, and a "Hold" position. Indicator 106 is lit when switch 104 is in the Pendant/Cab position, and indicator 108 is lit when switch 104 is in the "Auto" position. Either the pendant or cab mode of manual control is selected when switch 104 is in the Pendant/Cab position. The particular manual mode (either pendant or cab) is determined by selector switches on pendant controllers 58*a* and 58*b*. When switch 104 is in the Auto position, the remote mode of operation, in which power center controls 40 control crane 10 as a function of signals from computer 62, is selected.

In the lower center portion of cab control panel 56 is BRIDGE POSITION display 110, which is a six-digit display. Bridge position display 110 provides a digital readout indicating the position of bridge 12 with respect to the centerline of the metal refining plant. The bridge position displayed on bridge position display 110 is determined by power center controls 40 based upon signals from position encoders 46.

The orientation of rotate mast 14 is controlled by ROTATE switch 112, which is a momentary switch. Indicators 114 and 116 indicate the orientation of rotate mast 14.

ANODE/CATHODE SELECT switch 118 (FIG. 4A) selects which plates are to be handled by grapples 18 and 20. Anode plates are handled when switch 118 is in the "Anode" position, and cathode plates are handled when switch 118 is in the "cathode" position.

GRAB LOAD displays 120*a* and 120*b* are four-digit displays indicating the weight of the load on non-rotate mast 16 and rotate mast 14, respectively. The weights displayed by displays 120*a* and 120*b* are based upon signals supplied by load cells 50 to power center control 40.

GRAB ELEVATION displays 122*a* and 122*b* are four-digit displays which indicate the elevation of the non-rotate and rotate masts 16 and 14, respectively. The elevations displayed are based upon signals supplied by position encoders 46 to power center controls 40.

ANODE GRAB indicator lights 124*b* and 126*a* indicate whether the anode grabs of grapple 20 are open or closed. Similary, ANODE GRAB indicators 124*b* and 126*b* indicate whether the anode grabs of grapple 18 are open or closed.

CATHODE GRAB indicators 128*a* and 130*a* indicate whether the cathode grabs of grapple 20 are open or closed. Similarly, CATHODE GRAB indicators 128*b* and 130*b* indicate whether the cathode grabs of grapple 18 are open or closed.

GRAB INDEX indicators 132*a* and 134*a* indicate the index position of grapple 20, and GRAB INDEX indicators 132*b* and 134*b* similarly display the index position of grapple 18.

OVERLOAD indicators 136*a* and 136*b* provide an indication when an overload condition is present on non-rotate mast 16 and rotate mast 14, respectively. Similarly, UNDERLOAD indicators 138*a* and 138*b* provide an indication of when an underload condition is present on non-rotate and rotate masts 16 and 14, respectively.

The manual cab mode of operation of the crane 10 requires the operator to board crane 10 and seat himself in cab 24. When boarding and leaving crane 10, the operator uses the bridge hold mode, which ensures that the bridge drive system is disabled. This eliminates the possibility of operator injury which might otherwise occur if crane 10 were to unexpectedly accelerate under control of remote control console 60. In the preferred embodiment of the present invention, crane 10 also includes a pair of control boxes (not shown) mounted on bridge 12 to assist the operator in boarding and leaving crane 10. One control box includes a RECTIFIER EMERGENCY TRIP pushbutton (similar to pushbutton 92 on cab control panel 56), a BRIDGE HOLD pushbutton, and a RESUME pushbutton. The other control box includes a BRIDGE HOLD pushbutton and a RESUME pushbutton. Depressing the BRIDGE HOLD pushbutton disables the bridge drive system regardless of the control mode, and depressing the RESUME pushbutton allows bridge motion to resume.

Prior to operation, the operator makes a visual examination of crane 10 and the area in which it will operate. The operator makes certain that none of the moving parts of crane 10 are tied down or obstructed in any way by previous maintenance procedures.

The operator, upon entering cab 24, uses MAST SELECTION switch 96 to select either rotate mast 14, non-rotate mast 16, or both masts.

The operator controls bridge motion by joystick 84 located on righthand controller 54. The crane velocity is proportional to the deflection of joystick 84. Both masts 14 and 16 must be latched in their uppermost position before actuating joystick 84. The bridge position is continuously displayed by BRIDGE POSITION display 110 on control panel 56.

To enter a maintenance zone, the operator must simultaneously depress the BRIDGE END LIMIT BYPASS pushbutton 98 on control panel 56 and joystick 84.

The operator must place ANODE/CATHODE SELECT switch 118 in the anode position to handle anode plates or the cathode position to cathode plates. Grapples 18 and 20 must be empty and above a first predetermined elevation before a change in the position of ANODE/CATHODE SELECT switch 118 is permitted.

Grapples 18 and 20 may be indexed to the east or west position by actuating the GRAB INDEX joystick 78 on lefthand controller 52. If grapples 18 and 20 are empty, they may be indexed if they are above a second predetermined elevation. Grapples 18 and 20 must be raised to their uppermost limit (i.e. a third predetermined elevation) to index a load of cathode plates. GRAB INDEX joystick 78 is deactivated when grapples 18 and 20 are loaded with anodes.

Grapples 18 and 20 may be opened or closed to deposit or remove plates by actuating GRAB OPEN/CLOSE joystick 80 on lefthand controller 52. The position of ANODE/CATHODE select switch 118 determines whether the anode grabs or the cathode grabs of grapples 18 and 20 are actuated. GRAB OPEN pushbutton 82 on righthand controller 54 also must be depressed to allow grapples 18 and 20 to open.

The elevation of grapples 18 and 20 is controlled by GRAB RAISE/LOWER joystick 86 on righthand controller 54. The speed of the mast hoist drives 36 and 38 is proportional to the deflection of joystick 86. The elevation of grapples 18 and 20 and the weight of the load on each grapple is displayed by displays 122*a*, 122*b*, 120*a* and 120*b*, respectively, on control panel 56.

Orientation of rotate mast 14 is controlled by ROTATE select switch 112 on cab control panel 56. Rotate mast 14 must be at its upper limit (the third predetermined elevation) before mast orientation can be changed.

The Manual Pendant Mode of Operation

Figure 5A:
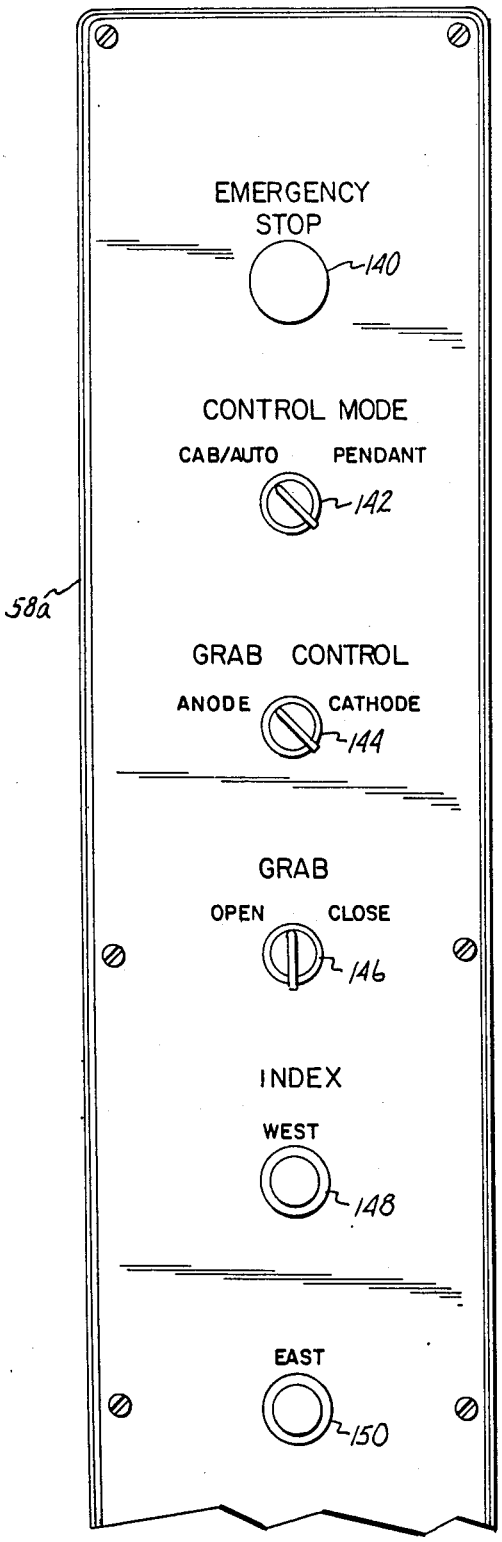
FIGS. 5A and 5B show a pendant controller mounted on the crane system of FIG. 1.
Figure 5B:
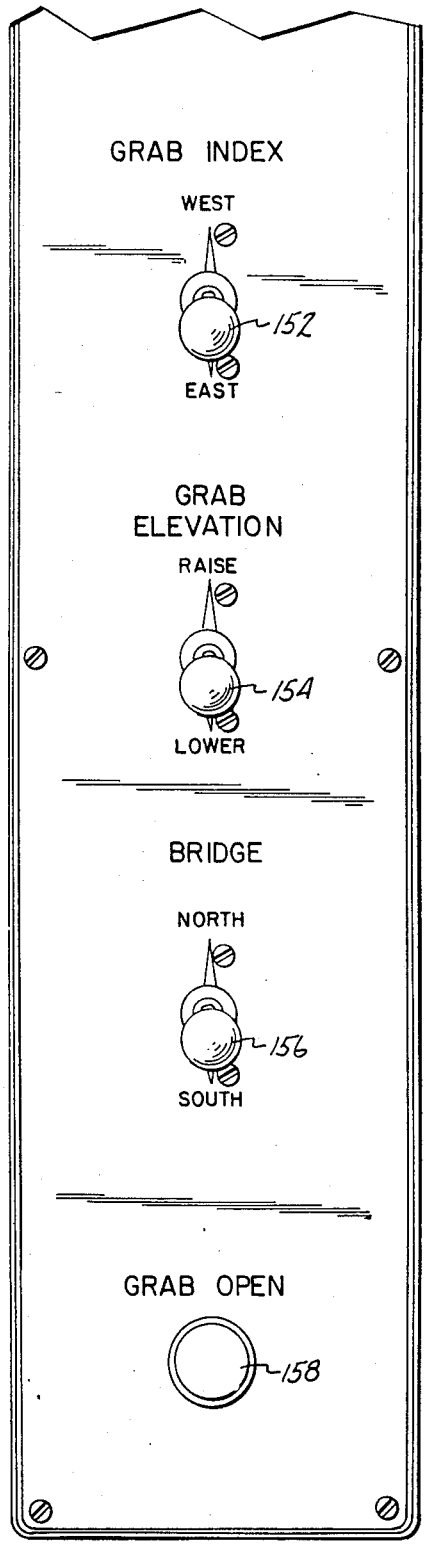

FIGS. 5A and 5B show pendant controller 58*a* used in the preferred embodiment of the present invention. The manual operator controls on pendant controller 58*a* are identical to those on pendant controller 58*b*, and therefore only pendant controller 58*a* will be discussed in detail.

Pendant controller 58*a* includes EMERGENCY STOP pushbutton 140, CONTROL MODE select switch 142, GRAB CONTROL select switch 144, GRAB OPEN/CLOSE select switch 146, INDEX indicators 148 and 150, GRAB INDEX joystick 152, GRAB ELEVATION joystick 154, BRIDGE NORTH/SOUTH joystick 156, and GRAB OPEN pushbutton 158.

EMERGENCY STOP pushbutton 140, when depressed, disables all functions of crane 10.

CONTROL MODE select switch 142 is used by the operator to select the desired crane operating mode. Switch 142 has a "Pendant" position and a "Cab/Auto" position. When switch 142 is in the "Pendant" position, control of crane 10 is in the pendant mode, regardless of the setting of selector switch 104 of cab control panel 56, and regardless of the status of remote control console 60. In other words, pendant control has highest priority among the three operating modes. If control mode selector switch 142 is in the "Cab/Auto" position, the operating mode of crane 10 is determined by CONTROL MODE select switch 104 on operator control panel 56.

GRAB OPEN/CLOSE selector switch 146 permits the operator to open or close the grab mechanisms.

GRAB INDEX joystick 152 permits the operator to select the index position of the grab mechanism. Indicator lights 148 and 150 display the index position of grapple 18 which is associated with pendant controller 58*a*.

GRAB ELEVATION joystick 154 controls elevation of grapple 18. The rate of change in elevation is proportional to deflection of joystick 154.

BRIDGE NORTH/SOUTH joystick 156 permits the operator to control the bridge drive system. The velocity of bridge 12 is proportional to deflection of joystick 156. In the preferred embodiments of the present invention the bridge velocity while in the pendant mode of operation is limited to a much lower velocity than is permitted in the cab and remote modes.

GRAB OPEN pushbutton 158 must be depressed by the operator to permit the grab mechanism to open.

The Automatic Remote Mode of Operation

Remote console 60 is the central core of automatic control of crane 10. From remote console 60 an operator can perform the following functions.

First, remote console 60 permits the operator to monitor status of crane 10, whether crane 10 is operating in the manual modes (cab or pendant) or in automatic remote mode. In the manual modes, the status information displayed by display 66 includes the particular control mode (either cab mode or pendant mode), the bridge position, the non-rotate mast elevation and load, and the rotate mast elevation and load. In the automatic remote mode, pertinent sequencing information is displayed by display 66 in addition to that which is displayed during the manual modes. This information includes the cell in service, whether anodes or cathodes are being serviced, whether east or west plates are being serviced, the current series of operations, and the last bridge destination. All of this information is available to the operator at all times except during an alarm condition.

Second, remote console 60 permits the operator to observe any condition which is sufficiently important to generate an audio alarm, suspend automatic crane operation, and display an error message to aid the operator in resolving the problem.

Third, remote console 60 enables the operator to suspend automatic operation at any time by placing crane 10 in either "hold" or "emergency stop" condition. Operation is resumed from "hold" simply by depressing a single pushbutton on auto control panel 64.

Fourth, remote console 60 enables the operator to easily program operation of crane 10 in the automatic mode in a minimum amount of tme with a minimum of training. This is achieved by prompting the operator through display 66 for the needed information and accepting only legal, reasonable responses. This procedure is managed by simple prompts displayed by display 66 in a consistent manner and by lighting only the response pushbuttons on auto control panel 64 that are legal responses to that particular prompt.

Fifth, remote console 60 enables the operator to view and modify the current schedule of operation of crane 10 either while crane 10 is in the automatic or the manual modes.

Sixth, remote console 60 enables the operator to increment the automatic sequence stored by computer 62 through the operating steps of crane 10 without running crane 10. This permits the operator to resynchronize computer 62 with power center control 40 after some steps have been performed in the manual mode. The system is then able to resume the automatic remote mode with computer 62 and power center controls 40 synchronized.

Seventh, remote console 60 enables the operator to operate crane 10 in single steps through an automatic sequence. This permits observation of crane 10 at each step before advancing to the next step, and thus is useful in identifying the potential problem areas in the operation of crane 10.

Eighth, remote console 60 enables the operator to initiate self-diagnostic tests of computer 62 and associated hardware. This procedure reports the status of the hardware and identifies any suspected fault.

Figure 6:
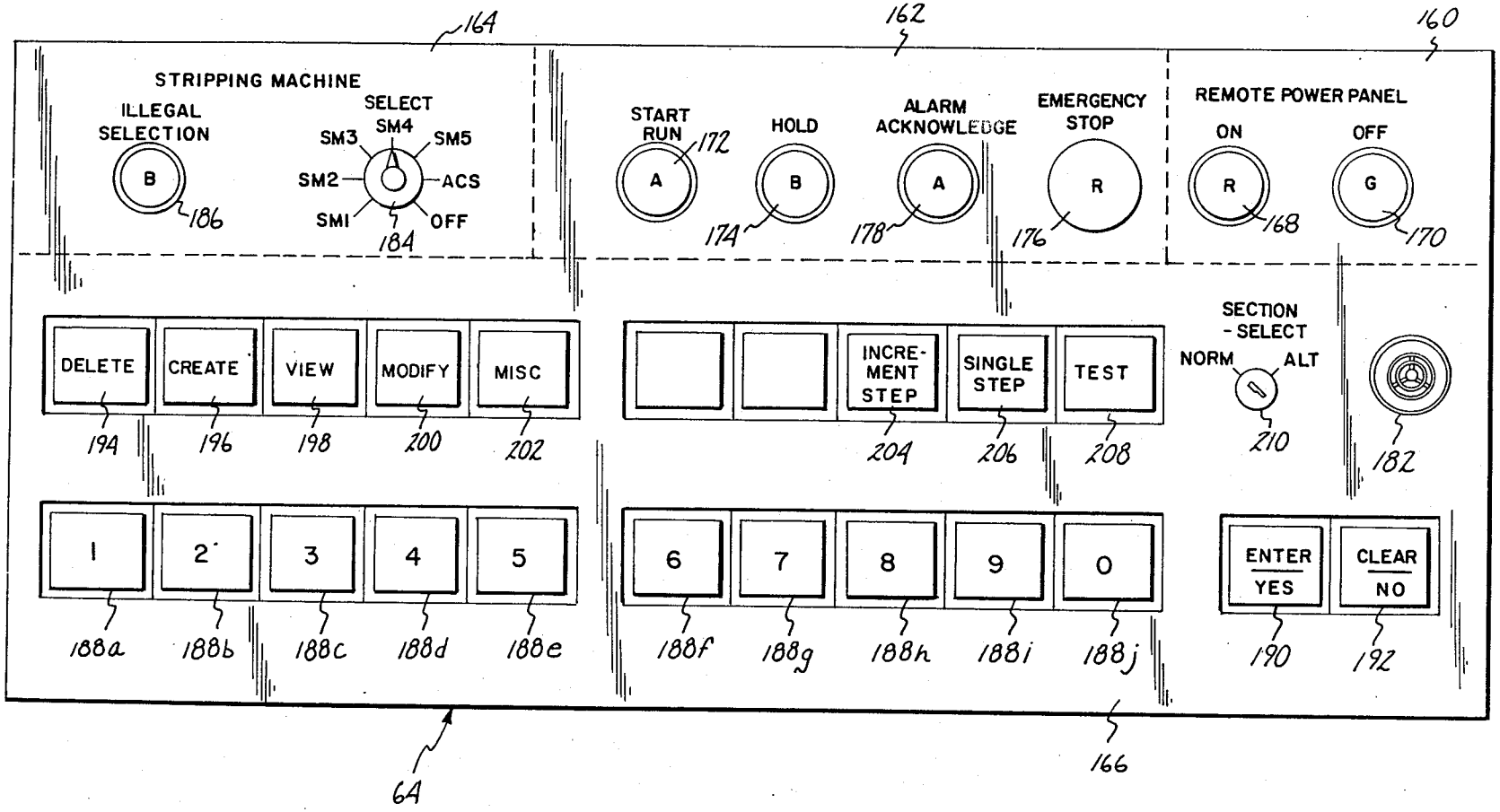
FIG. 6 shows an auto control panel used in remote control of the crane system of FIG. 1.

FIG. 6 shows auto control panel 64, which permits a remotely located operator to control operation of crane 10. As shown in FIG. 6, auto control panel 64 includes four functional control areas 160, 162, 164 and 166.

Power on/off control area 160 is in the upper right-hand corner of auto control panel 64. ON and OFF pushbuttons 168 and 170 control power to remote control console 60 and to microwave transmitter/receiver 68. Pushbuttons 168 and 170 are lit when actuated, thus informing the operator of the state of the remote control system.

Auto sequencing control area 162 includes RUN, HOLD, EMERGENCY STOP and ALARM ACKNOWLEDGE pushbuttons 172, 174, 176 and 178. Each button 172, 174, 176 and 178 is lit when actuated, and thus indicates the status of the remote control at any time when power is on. Automatic crane operation can be suspended at any time by depressing either HOLD button 174 or EMERGENCY STOP button 176. When EMERGENCY STOP pushbutton 176 is depressed, it is maintained in that state and must be pulled up by the operator to enable any subsequent automatic operation. The RUN pushbutton 172 is the primary method of initiating crane automatic operation. Before computer 62 and power center controls 40 permit RUN pushbutton 172 to initiate any crane motion, none of the following predetermined conditions must be present:

(1) Remote EMERGENCY STOP pushbutton 176 is depressed.
(2) Remote Communications link down.
(3) Crane 10 is in the cab mode.
(4) Crane 10 is in the pendant mode.
(5) Crane 10 is not in the remote mode.
(6) Crane 10 is not on.
(7) Crane EMERGENCY RECTIFIER TRIP pushbutton 92 is depressed.
(8) Crane main contactor is not energized.
(9) Crane isolation violation is detected.
(10) Crane EMERGENCY STOP pushbutton 76 is depressed.
(11) Crane water tank empty.
(12) Crane 10 is at the bridge north limit of travel.
(13) Crane 10 is at the bridge south limit of travel.
(14) Crane communications link down.
(15) Crane non-rotate mast 16 is overloaded.
(16) Crane rotate mast 14 is overloaded.
(17) Remote illegal stripping machine/anode cleaning station selection by switch 184.
(18) Remote schedule does not exist is memory of computer 62.
(19) Remote schedule does not agree with section selected by keyswitch 210.

If RUN or HOLD pushbutton 172 or 174 is depressed when any one of these conditions is present, alarm 182 is actuated, ALARM ACKNOWLEDGE button 178 is flashed, and a message is displayed on display 66. Alarm 182 is silenced and display 66 returns to normal when the operator pushes ALARM ACKNOWLEDGE button 182.

SM/ACS select area 164 enables stripping machine/anode cleaning station selection. Selection can only occur while crane 10 is in a hold mode, and any attempt to change selection switch 184 while crane 10 is running suspends automatic operation. SM/ACS select switch 184 enables the operator to request control of one of the stripping machines or the anode cleaning station of the refining plant. In preferred embodiments of the present invention, in which more than one crane is operating within the plant, control of a stripping machine or anode cleaning station will not be granted if the stripping machine or anode cleaning station being requested is already in use by another crane, or if the selection requested would require crane 10 to overlap travel required by another crane. Illegal selection light 186 indicates the legality of each selection as SM/ACS select switch 184 is rotated.

Primary interactive operator response area 166 includes two rows of lighted pushbuttons 188a–208, and key-operated SECTION SELECT switch 210. The lower row includes numerical pushbuttons 188a through 188j (which represent numerical values "1" through "0"); ENTER/YES pushbutton 190; and CLEAR/NO pushbutton 192. These are the "interactive response" pushbuttons which receive the operator's response to displayed prompts. The specific functions of pushbuttons 188a–188j, 190 and 192 vary from one procedure to another and even within a given procedure. The prompt message on display 166 informs the operator of the legal responses from among pushbuttons 188a–192, and only those pushbuttons which represent legal responses are lit. In this way, it is easy for the operator to see his "options". If the operator depresses a pushbutton which is not lit, computer 62 ignores this illegal response.

The upper row of pushbuttons includes DELETE button 194, CREATE button 196, VIEW button 198, MODIFY button 200, MISC button 202, INCREMENT STEP button 204, SINGLE STEP button 206, and TEST button 208.

Depressing DELETE button 194 permits the operator to delete a current schedule. This procedure is legal only if a schedule exists and crane 10 is in "Hold". The effect of this procedure is to delete the existing schedule, and to reset the sequence of operation in preparation for a new schedule. Depressing DELETE button 194 a second time exits the DELETE procedure and enables a new procedure to be selected from among pushbuttons 196–208.

Depressing CREATE button 196 permits the operator to create a new schedule. This procedure is legal only if no schedule currently exists and crane 10 is in Hold. The effect of the create procedure is to generate a new schedule made of a list of up to twelve series. Each series consists of sufficient information to service a consecutive group of cells or work stations all requiring the same type of service. The create procedure leads the operator through a list of questions to generate each series. Each question is prompted on display 66 and the operator responses are reflected in the schedule. For each series, the computer 62 requires the operator to provide the following information:

a. either east or west index;
b. either anodes or cathodes;
c. either rotate mast 14, non-rotate mast 16 or both masts in operation;
d. the first and last cells of the series. (If both masts have been selected for operation then all cells between the first and last cell must require the same service).

After one series has been completed, the operator may create another series, up to a total of twelve series in one schedule.

Depressing VIEW button 198 permits the operator to view the current schedule. This procedure is legal at any time that a schedule exists. Crane 10 may be in "Hold" or may be running.

Depressing the MODIFY button 200 permits the operator to modify the current schedule. This procedure is legal anytime a schedule exists. The crane may be in Hold or may be running. The effect of the modify procedure is to alter the existing schedule by either deleting, replacing or inserting a specific series. The operator is not allowed, however, to modify any series that has been or is being executed. Rather, the operator is permitted to alter any series which has not yet been commenced.

Depressing the MISC button 202 permits the operator to change various miscellaneous parameters stored by computer 62. This procedure is legal at any time. In a preferred embodiment of the present invention, the parameters which can be set and displayed in the Misc procedure include the elapsed running time of remote control console 60; the number of messages between power center control 40 and computer 62 which have been rejected due to transmission or reception errors; the maximum number of seconds the water spray system is turned on when starting bridge travel after removing a set of cathodes from a cell; the time used in each cell service cycle once over the cell; how far down the plates are lowered into an acid dip tank; the index location of the wash cell which is currently empty; and the index location of the drip rack which is currently empty.

Depressing the INCREMENT STEP button 204 permits the operator to increment computer 62 so as to synchronize it with crane 10. This procedure is legal any time a schedule exists and crane 10 is in hold. By sequentially incrementing computer 62 through the individual steps of a series, resynchronization between computer 62 and power center controls 40 is possible. This function is necessary when, during automatic control operation, the operator has suspended operation of crane 10, and some of the steps of the series have been performed under manual control. As the sequence of operation is advanced using the INCREMENT STEP button 204, descriptions of the consecutive steps are displayed on display 66. This allows the operator in the remote control room, while communicating with the operator on crane 10, to synchronize computer 62 with power center controls 40 and to follow the steps which are being performed manually.

Depressing SINGLE STEP button 206 permits the operator in the remote control room to step crane 10 through a sequence of steps one-at-a-time. This procedure is similar to the Increment Step procedure, except that crane 10 is actually operated as each step is requested. This procedure is used primarily to isolate potential problems in the operation of crane 10, since it enables the operator to slowly advance crane 10 through the sequence of steps, with pauses between the individual steps for detailed observation.

Depressing TEST button 208 permits the operator to initiate self-diagnostic tests performed by computer 62. The test procedure can only be initiated when crane 10 is in Hold. When initiated, the entire control system enters a testing mode and the test results are displayed on display 66. After each individual-test is completed, its outcome is recorded on display 66.

Display 66 is preferably a cathode ray tube (CRT) display which is capable of displaying information in three different sizes for use in an alarm condition mode, a normal condition mode, and an active condition mode. The largest size display is used for the alarm condition mode. FIG. 7A illustrates the display format during the alarm condition mode. This mode is used solely to draw the operator's attention to an alarm condition message. The message is accompanied by an audio alarm from alarm 82 and flashing of ALARM ACKNOWLEDGE button 180 on auto control panel 64. When ALARM ACKNOWLEDGE button 180 is depressed, computer 62 knows that it has received the operator's attention, and display 66 is returned to the normal condition mode to supply the operator with more information from which the operator can determine the cause of the alarm.

FIG. 7B illustrates the display format used in the normal condition mode. This mode furnishes the operator with all the status information he needs to observe operation of crane 10. This information includes all of the information from the alarm condition mode, which is displayed in the upper lefthand corner of the display, as illustrated in FIG. 7B. In addition, schedule sequence status is displayed in the upper righthand corner. The schedule sequence status includes the active series number, the cell being serviced, whether anodes or cathodes are being serviced, and whether east or west plates are being serviced.

In the lower half, information relating to the operation then in progress is displayed to enable the operator to monitor the sequencing process and to aid him in resolving false conditions which result in alarm conditions. This information includes bridge position, last bridge destination, both mast elevations, and the loads on the masts. The display of the operation that the crane was performing when a fault condition occurred is maintained after the alarm is acknowledged by the operator.

The third and most detailed display size is used in the active condition mode, which is illustrated in FIG. 7C. The use of this mode is for conveying information to the operator that is required only while he is actively interacting with computer 62 through auto control panel 64. This occurs when the schedule is viewed, the old schedule is deleted, a new schedule is created, modifications are made to an existing schedule, miscellaneous parameters are adjusted, the sequence is manually incremented, or a self-diagnostic test is executed. The prompts to request information for all of these procedures are displayed in the lower lefthand corner of display 66, as illustrated in FIG. 7C. All of the status information displayed in the normal condition mode is displayed in reduced size format in the upper lefthand corner of display 66. The right half of display 66 displays schedule information and test status information.

Before operation in the remote mode is possible, the location of each cell and work station within the refining plant, and the elevation of each of the cells and work stations must be determined. This is done by operating crane 10 in a manual mode. The bridge position for each cell and work station is determined by observing bridge position display 110 on cab control panel 56. Similarly, the grab elevations for grapples 18 and 20 at each of the various cells and work stations are displayed on grab elevation displays **122*a* and 122*b*, respectively. The operator in the cab records all of this information to provide a "map" of the refining plant. This information is then stored in computer memory within computer 62, so that computer 62 has, for each cell and work station, the necessary position and elevation information to control crane 10**.

During remote operation of control 10, computer 62 provides control signals to power center controls 40 as a function of the stored position and elevation information, and the stored schedule. Power center controls 40 supply position information and load information, and control the various drives and actuators of crane 10 as a function of the remote control signals from computer 62.

Electrical Operation Interlocks

Although the operation of crane 10 is controlled by computer 62 when crane 10 is in the remote mode, power center controls 40 provide a number of operational interlocks which prevent operation of crane 10 if potentially dangerous conditions are present, despite the control signals supplied by computer 62. These same interlocks are also in effect when crane 10 is operating in the pendant mode and the cab mode.

When operating in the cab or the remote mode, power center controls 40 disable bridge drive motor 26 unless both rotate mast 14 and non-rotate mast 16 are latched in their up limits (the third predetermined elevation), with the grab mechanisms in predetermined positions. This determination is based upon signals from position encoders 46 and limit switches 48. When the pendant mode of operation is selected, bridge drive motor 26 may be enabled even though masts 14 and 16 are not at their up limits provided both are raised above the second predetermined elevation (as determined by signals from position encoders 46).

Bridge drive motor 26 is also disabled, regardless of control mode, when crane 10 reaches either end limit of its travel on the track. Limit switches 48 include a limit switch at each end limit of normal travel of crane 10. BRIDGE END LIMIT BYPASS button 98 permits bridge drive motor 26 to be enabled in order to permit crane 10 to move into a maintenance area.

The selection of cathode handling or anode handling is disabled unless grapples 18 and 20 are both above a predetermined elevation and are free of cathodes and anodes. This determination is made by power center controls 40 based upon signals from position encoders 46, limit switches 48, and load cells 50.

Grapple actuators 40 and 42 are enabled to permit indexing only if grapples 18 and 20 are empty and are raised above a predetermined elevation, or if grapples 18 and 20 are loaded with cathodes (as determined by signals from limit switches 48 and load cells 50) and raised to the up limit (as determined by signals from position encoders 46).

Similarly, the anode and cathode grab mechanisms of grapples 18 and 20 are permitted to open or close only under predetermined conditions based upon signals from position encoders 46, limit switches 48, and load cells 50.

Mast rotate drive 39 is enabled only when rotate mast 14 is at its up limit and the mechanisms of grapple 18 are in predetermined positions which depend upon whether grapple 18 is loaded with cathodes or anodes.

Interlocks are also provided to prevent operation of rotate mast hoist 36 and non-rotate mast hoist 38 unless certain conditions are met. For example, crane 10 is prevented from inadvertently removing both sets of anodes or cathodes from a cell and thereby potentially disrupting the current flow in the electrolytic cell. In addition, the interlocks prevent raising or lowering masts 14 and 16 under a variety of other potentially dangerous conditions.

Control panel 56 includes an isolation override switch 94 which, when placed in the "Normal" position, activates an isolation failure detector system. If an isolation failure occurs, an alarm is energized, and an electrical interlock in power center controls 40 prevents either mast 14 or 16 from being raised or lowered. If it is necessary to operate masts 14 and 16 without first correcting the cause of the isolation failure, this interlock (which prevents operation of hoists 36 and 38), may be bypassed at the operator's discretion by placing isolation override switch in the "Override" position.

EMERGENCY STOP pushbutton 76 is provided on lefthand controller 52; EMERGENCY STOP pushbuttons 140 are provided on pendant controllers 58*a* and 58*b;* and EMERGENCY STOP pushbutton 178 is provided on remote control panel 64. Depressing any one of these EMERGENCY STOP pushbuttons disables all crane drive functions, regardless of the current mode of operation.

Depressing RECTIFIER EMERGENCY TRIP pushbutton 92 on cab control panel 56, or a similar pushbutton at either of the control boxes mounted on bridge 12 disables all crane drive functions. In addition, a relay located in remote console 60 is actuated to provide an emergency trip signal for the rectifier control of the refining plant.

The Communication Link

As illustrated in FIG. 2, the preferred embodiments of the invention utilize a microwave communication link between power center controls 40 and computer 62. Although other types of radio communications are possible, the microwave communication link of the present invention is particularly advantageous. In the preferred embodiments of the present invention, microwave transmitter/receivers 72 and 68 allow full duplex operation of both audio subcarriers (for the data transmission between computer 62 and power center controls 40) and video subcarriers. Crane 1 therefore preferably carries one or more remote control television cameras or infrared scanners (video camera 212 shown in FIG. 2. The video signals from the television cameras or infrared scanner are supplied from microwave transmitter/receiver 72 to microwave transmitter/receiver 68, which drives one or more video monitors 214 (shown in FIG. 2) in the remote control room. This permits the operator in the remote control room to monitor the operation of the crane 10 both visually and by means of the information displayed on display 66.

In addition, the use of microwave transmission permits a restricted beamwidth between antennas 70 and 74. This prevents interference and provides a very secure means of control of crane 10 by computer 62. The danger of other transmitters interfering or jamming the transmission is significantly reduced.

In the preferred embodiments of the present invention, two audio subcarriers are provided for transmitting information from crane 10 to computer 62. The first audio subcarrier from microwave transmitter/receiver 72 supplies the data from power center controls 40. The second audio subcarrier provides an indication that power center controls 40 and crane 10 are in operation. If both audio subcarriers are present, this indicates to computer 62 that power center controls 40 are operational. Similarly, if both audio subcarriers are absent, this indicates that power center controls 40 and crane 10 are shut down. If, however, only one of the two audio subcarriers is present, this indicates to computer 62 that a malfunction has occurred. In the preferred embodiments of the present invention, computer 62 shuts down the entire refining plant process, since the loss of one of the two audio subcarriers indicates a potentially dangerous condition.

An audio subcarrier is supplied from microwave transmitter 68 which provides data from computer 62. If power center controls 40 receive the audio subcarrier, this indicates that console 60 is in operation. If the subcarrier is absent, power center controls 40 assume that remote console 60 is not in operation. The absence of the audio subcarrier signals a potential safety problem, and interlocks of power center controls 40 prevent operation of crane 10 in the remote control mode.

Conclusion

The automatic material handling crane system of the present invention permits automatic operation of a crane by remote control. The remote operator is permitted to schedule the operations of the crane quickly and simply, and without the need for entering detailed instructions as to the location of each work station to be serviced, or the individual steps to be performed at each work station. Instead, the operator enters various series of work stations or cells requiring similar service, and the remote control computer automatically controls the crane as a function of the schedule formed by the various series, stored information as to the location of each cell within the plant, and stored information as to the individual steps to be performed. In the preferred embodiments of the present invention, two forms of manual control of the crane are also provided. Thus the crane can be operated under manual control in the event of a malfunction in the remote control system, or for maintenance or repair purposes. Extensive interlocks are provided in the controls carried by the crane to prevent operation of the crane under either manual or automatic remote control if potentially dangerous conditions exist.

Although the present invention has been described with reference to preferred embodiments, workers skilled in the art will recognize that changes may be made in form and detail without departing from the spirit and scope of the invention.

What is claimed is:

1. A system for performing material handling at a plurality of stations, the system comprising:

movable means movable to each of the plurality of stations;

a material handling mechanism carried by the movable means;

drive means for moving the movable means;

actuator means for operating the material handling mechanism;

means for providing signals indicative of the position of the movable means;

means for providing signals indicative of operating status of the material handling mechanism;

manual control means carried by the movable means for providing manual control signals;

remote control means, positioned at a remote location with respect to the movable means, for providing remote control signals based on a stored schedule and status information relating to the movable means and the material handling mechanism the remote control means comprising:

station location storage means for storing a first set of data representative of a location for each station;

service step storage means for storing a second set of data representative of a sequence of individual operating steps of the movable means and the material handling mechanism for each of a plurality of different types of material handling service which can be performed by the movable means and the material handling mechanism at the stations;

operator controlled schedule creating means for producing first, second and third operator input signals to create a third set of data representing the schedule the operator controlled schedule creating means comprising:

first operator input means for providing a first operator input signal which identifies a series which is included in the schedule, wherein the series denotes a plurality of stations at which the same type of material handling service is to be performed;

second operator input means for providing a second operator input signal which identifies which of the stations represented by the first set of data are included in the identified series; and third operator input means for providing a third operator input signal which identifies which of the plurality of different types of service represented by the second set of data is to be performed at the identified stations of the identified series;

schedule storage means for storing the third set of data representing the schedule based upon the first, second and third operator input signals; and remote control signal producing means for producing the remote control signals which represent each step of operation of the drive means and the actuator means during the schedule based upon the first, second and third sets of data and the status information;

selection means for selecting control signals from among manual control signals and the remote control signals;

control means carried by the movable means for providing control signals to the drive means and the actuator means as a function of the selected control signals, and for providing the status information as a function of the signals indicative of position of the movable means and the signals indicative of operating status of the material handling mechanism;

first microwave transmitter means at the remote location for transmitting a first microwave beam to the movable means, the first microwave beam having a subcarrier for providing the remote control signals;

second microwave transmitter means carried by the movable means for transmitting a second microwave beam to the remote location, the second microwave beam having first and second subcarriers, the first subcarrier providing the status information and the second subcarrier indicating whether the control means carried by the movable means is operating;

first microwave receiver means at the remote location for receiving the second microwave beam; and second microwave receiver means carried by the movable means for receiving the first microwave beam; and wherein the remote control means further includes disable means for disabling operation of the movable means and the material handling mechanism if only one of the first and second subcarriers is present in the second microwave beam as received by the first microwave receiver means.

2. A system for servicing a plurality of stations, the system comprising:

movable means movable to each of the plurality of stations;

a material handling mechanism carried by the movable means;

drive means for moving the movable means;

actuator means for operating the material handling mechanism;

means for providing signals indicative of the position of the movable means;

means for providing signals indicative of operating status of the material handling mechanism;

remote control means positioned at a remote location with respect to the movable means, the remote control means storing a schedule of operations of the movable means and the material handling mechanism and providing remote control signals based on the schedule and status information relating to the movable means and the material handling mechanism;

control means carried by the movable means for providing signals to the drive means and the actuator means as a function of the remote control signals, and for providing the status information as a function of the signals indicative of position of the movable means and the signals indicative of operating status of the material handling mechanism;

first microwave transmitter means at the remote location for transmitting a first microwave beam to the movable means, the first microwave beam having a subcarrier for providing the remote control signals; and second microwave transmitter means carried by the movable means for transmitting a second microwave beam to the remote location, the second microwave beam having first and second subcarriers, the first subcarrier providing the status information and the second subcarrier indicating whether the control means carried by the movable means is operating;

first microwave receiver means at the remote location for receiving the second microwave beam;

second microwave receiver means carried by the movable means for receiving the first microwave beam; and disable means for disabling operation of the movable means and the material handling mechanism if only one of the first and second subcarriers is present in the second microwave beam as received by the first microwave receiver means.

3. The system of claim 2 and further comprising:

video means carried by the movable means for viewing a scene which includes at least one station and providing video signals to the second microwave transmitter means, and wherein a second microwave beam from the second microwave transmitter means includes a video subcarrier; and video display means at the remote location for receiving video signals derived from the video subcarrier by the first receiver means and displaying images of the scene.

4. A system for moving electrolytic plates from station-to-station in a multi-station electrolytic metal refining process, the system comprising:

a crane movable on a generally horizontal track;

a mast carried by and movable with respect to the crane;

a plate grabbing mechanism carried by the mast;

crane position encoder means for providing signals indicative of a position of the crane on the track;

mast position encoder means for providing signals indicative of a position of the mast;

crane drive means for moving the crane;

mast drive means for moving the mast;

actuator means for operating the plate grabbing mechanism;

remote control means positioned at a remote location with respect to the crane, the remote control means storing a schedule of operations of the crane, the mast, and the plate grabbing mechanism and providing remote control signals based upon the schedule and status information relating to the crane, the mast and the plate grabbing mechanism;

control means carried by the movable means for providing signals to the crane drive means, the mast drive means, and the actuator means as a function of the remote control signals to move the plates from station-to-station, and for providing status information as a function of the signals from the crane position encoder means and mast position encoder means;

first microwave transmitter means at the remote location for transmitting a first microwave beam to the crane, the first microwave beam having a subcarrier for providing the remote control signals;

second microwave transmitter means carried by the crane for transmitting a second microwave beam to the remote location, the second microwave beam having first and second subcarriers, the first subcarrier providing the status information and the second subcarrier indicating whether the control means carried by the crane is operating;

first microwave receiver means at the remote location for receiving the second microwave beam;

second microwave receiver means carried by the crane for receiving the first microwave beam; and means for removing electrical power to shut down operation of the metal refining process if only one of the first and second subcarriers is present in the second beam as received by the first microwave receiver means.

5. The system of claim 4 and further comprising:

means for disabling operation of the crane and the mast if only one of the first and second subcarriers is present in the second microwave beam as received by the first microwave receiver means.

* * * * *